US009657581B2

(12) United States Patent
Woehler et al.

(10) Patent No.: US 9,657,581 B2
(45) Date of Patent: May 23, 2017

(54) ROTOR FOR A TURBOMACHINE

(71) Applicant: MTU Aero Engines GmbH, Munich (DE)

(72) Inventors: Marcus Woehler, Puchheim (DE); Martin Pernleitner, Dachau (DE); Rudolf Stanka, Rattenkirchen (DE)

(73) Assignee: MTU Aero Engines GmbH, Munich (DE)

( * ) Notice: Subject to any disclaimer, the term of this patent is extended or adjusted under 35 U.S.C. 154(b) by 1012 days.

(21) Appl. No.: 13/746,650

(22) Filed: Jan. 22, 2013

(65) Prior Publication Data

US 2013/0189111 A1 Jul. 25, 2013

(30) Foreign Application Priority Data

Jan. 23, 2012 (EP) ..... 12152073

(51) Int. Cl.
*F01D 5/30* (2006.01)
*F01D 5/26* (2006.01)
*F01D 25/06* (2006.01)

(52) U.S. Cl.
CPC ..... *F01D 5/3038* (2013.01); *F01D 5/26* (2013.01); *F01D 5/3007* (2013.01); *F01D 25/06* (2013.01); *F05D 2240/80* (2013.01); *F05D 2260/36* (2013.01); *Y10T 29/4932* (2015.01)

(58) Field of Classification Search
CPC ... F01D 5/14; F01D 5/143; F01D 5/30; F01D 5/3007; F01D 5/3023; F01D 5/303; F01D 5/3038; F01D 5/22; F01D 5/26; F01D 25/06; F05D 2240/80; F05D 2260/36
See application file for complete search history.

(56) References Cited

U.S. PATENT DOCUMENTS 1,778,066 A 10/1930 Doran
2,220,918 A * 11/1940 Smith ..... F01D 5/225 416/191
2,271,971 A 2/1942 Doran
2,781,998 A 2/1957 Barr
3,014,695 A 12/1961 Rankin et al.
3,216,700 A 11/1965 Bostock, Jr.
(Continued)

FOREIGN PATENT DOCUMENTS

DE 10 2007 014 886 10/2007
EP 0899426 A2 3/1999
(Continued)

*Primary Examiner* — Dwayne J White
*Assistant Examiner* — Kayla McCaffrey
(74) *Attorney, Agent, or Firm* — Davidson, Davidson & Kappel, LLC

(57) ABSTRACT

A rotor for a turbomachine, in particular for a jet engine, having a blade ring which includes multiple differently designed rotor blades (10*a*, 10*b*) having blade platforms (14*a*, 14*b*) engaged flush with one another, the blade ring including at least two groups of differently designed rotor blades (10*a*, 10*b*), each group of rotor blades (10*a*, 10*b*) being assigned blade platforms (14*a*, 14*b*), each of which is engageable flush with a matching blade platform (14*a*, 14*b*) of at least one other group of rotor blades (10*a*, 10*b*) and not with a blade platform (14*a*, 14*b*) of the same group of rotor blades (10*a*, 10*b*). A method for manufacturing a blade ring of a rotor for a turbomachine is also provided.

14 Claims, 1 Drawing Sheet

(56) References Cited

U.S. PATENT DOCUMENTS

| | | | | | |
|---|---|---|---|---|---|
| 3,923,420 | A * | 12/1975 | Chifos | F01D 5/3038 | 416/190 |
| 4,084,922 | A | 4/1978 | Glenn | | |
| 4,460,316 | A | 7/1984 | Partington | | |
| 4,676,723 | A | 6/1987 | Kiger et al. | | |
| 4,878,810 | A * | 11/1989 | Evans | F01D 5/16 | 416/175 |
| 6,217,282 | B1 | 4/2001 | Stanka | | |
| 7,766,625 | B2 | 8/2010 | Burdgick et al. | | |
| 8,888,459 | B2 * | 11/2014 | Noble | F01D 5/22 | 416/193 A |
| 2005/0042384 | A1 | 2/2005 | Benedetti et al. | | |
| 2009/0246029 | A1 | 10/2009 | Saito et al. | | |

FOREIGN PATENT DOCUMENTS

| | | |
|---|---|---|
| FR | 1340331 | 10/1963 |
| JP | S5578103 | 6/1980 |
| WO | WO 03/062606 | 7/2003 |
| WO | WO2007063848 | 6/2007 |

* cited by examiner

ROTOR FOR A TURBOMACHINE

This claims the benefit of European Patent Application EP 12152073.8, filed Jan. 23, 2012 and hereby incorporated by reference herein.

The present invention relates to a rotor for a turbomachine, in particular for a jet engine. The present invention furthermore relates to a method for manufacturing a blade ring of a rotor for a turbomachine as well as a jet engine.

BACKGROUND

Rotors for turbomachines are known in various designs. A generic rotor includes a blade ring which has multiple rotor blades having blade platforms engaged flush with one another. The blade platforms are in this case each situated in the radial direction between the blade and the blade root of the individual rotor blades and form an inner delimitation of the flow path through the turbomachine when the rotor is installed. The coordination of the vibration behavior of bladed rotors is in this case of outmost importance for a design of a turbomachine. In thermal gas turbines such as jet engines, in particular, which are operated in different speed ranges, the frequency detuning is very difficult. Known methods for frequency detuning propose the provision of rotor blades having different individual frequencies. This usually takes place by adding or removing masses. For this purpose, bore holes or pockets, which are subsequently filled with additional matter of a different type, are introduced into the blades of the rotor blades, as described in DE 10 2007 014 886 A1, for example. Alternatively, it is known from WO 03/062606 A1 that the additional matter is applied as coating on the pressure side and/or the suction side of the rotor blade in the area of the blade tip of the blade in order to obtain differently designed rotor blades having their respective different natural vibrations.

BRIEF SUMMARY OF THE PRESENT INVENTION

These known types of frequency detuning, however, are complex from the manufacturing standpoint and are comparably expensive. Moreover, it cannot be reliably ruled out that two identically designed rotor blades having an identical vibration behavior are arranged next to one another.

It is an object of the present invention to provide a generic rotor which has a desirable vibration behavior and is at the same time manufacturable in a simpler and more reliable manner. Another alternate or additional object of the present invention is to provide a method for manufacturing a blade ring of a rotor for a turbomachine which makes a simpler and more reliable manufacture of a rotor having a desirable vibration behavior possible. Finally, it is an alternate or additional object of the present invention to provide a jet engine having such a rotor.

The present invention provides a rotor for a turbomachine which has a desirable vibration behavior and is at the same time manufacturable in a simpler and more reliable manner is provided according to the present invention in that the blade ring includes at least two groups of differently designed rotor blades, each group of rotor blades being assigned blade platforms, each of which is engageable flush with a matching blade platform of at least one other group of rotor blades and not with a blade platform of the same group of rotor blades. In other words, it is provided according to the present invention that the rotor blades, of which the blade ring of the rotor is made, are designed in such a way that two identical rotor blades which accordingly belong to the same group or the same rotor blade type and have the same blade platforms may not be installed flush with one another, since it would not be possible to engage the blade platforms flush with one another in the case of a wrong configuration and thus a gap would always remain between the identically designed blade platforms of the rotor blades of an individual group. Due to the resulting additional demand of installation space, it would in addition no longer be possible to close the blade ring. With the aid of the embodiment of the rotor blades according to the present invention, only those rotor blades may instead be arranged flush with one another which belong to different groups and whose blade platforms, on the one hand, differ geometrically from one another and, on the other hand, are designed in such a way that they match. In the simplest embodiment of the present invention, only two different groups of rotor blades are thus needed. Basically, however, three or more groups of differently designed rotor blades may also of course be used, it being basically the case that at least blade platforms of the same group of rotor blades are not engageable flush with one another due to their group-specific design. In this way, an integral protection against a mix-up is provided according to the present invention in the area of the hub platform of the rotor due to which it is reliably made impossible to arrange two identically designed rotor blades having an identical vibration behavior flush with one another and to attach them to the blade ring. Additional components are not needed to ensure protection against a mix-up so that there is advantageously no unfavorable effect on the weight of the rotor. The present invention thus makes it possible in a structurally simple and cost-effective manner to reliably manufacture a rotor having a desirable frequency detuning in which it is reliably ruled out that two identical rotor blades are accidentally arranged next to one another.

In one advantageous embodiment of the present invention, it is provided that each blade platform of a first group of rotor blades has at least one recess which is situated on the edge and in which a matching projection, situated on the edge, of an adjacent blade platform of an associated second group of rotor blades is arranged in a form-locked manner. A structurally particularly simple protection against a mix-up is thus provided. Moreover, an appropriate design of the recess and the associated projection makes it particularly easily possible to "interlock" adjacent rotor blades, whereby, in addition to the protection against a mix-up, the mechanical stability of the rotor under changing operating conditions, e.g., under changing operating temperatures and operating pressures, is advantageously additionally improved.

Additional advantages result in that the recess and/or the projection of the blade platform in question is/are introduced into the blade platform in question with the aid of a separation process, in particular by milling and/or grinding. This allows for additional cost reductions, since rotor blades having identically designed blade platforms may initially be manufactured. The corresponding recesses and projections may be subsequently introduced into the blade platforms with the aid of the separation process. This also makes it possible to provide initially conventional rotor blades having uniformly designed blade platforms and subsequently finish them in the sense of the present invention, whereby additional cost reductions are implemented during the manufacture as well as during the repair and overhaul of the corresponding rotors. In addition, the present invention may thus also be used with already existing rotors or rotor blades. Alternatively or additionally, it may of course also be provided that the at least two different groups of rotor blades are manufactured with the aid of deviating manufacturing processes, e.g., by master forming and/or joining.

In another advantageous embodiment of the present invention, it is provided that each blade platform of the first group of rotor blades has a recess, situated on the edge, as well as an opposite projection, situated on the edge, and each blade platform of the second group of rotor blades has a projection which is situated on the edge and which matches the recess of the blade platform of the first group and a recess which is situated on the edge and which matches the projection of the blade platform of the first group. In this way, it is possible for adjacent blade platforms to interlock at their opposite edge areas, whereby a mechanically particularly stable connection of the individual rotor blades may be achieved, while ensuring a protection against a mix-up at the same time.

In another advantageous embodiment of the present invention, it is provided that the recesses and the matching projections are formed in the area of the lateral contact surfaces of the rotor blades, the projections being form-locked in their respective recesses. This represents a structurally simple possibility of connecting adjacent rotor blades to one another in a mechanically stable manner using a type of tongue and groove joint.

In another embodiment of the present invention, a particularly effective frequency detuning of the rotor is achieved in that the at least two groups of rotor blades have different blade geometries. In other words, it is provided according to the present invention that each group of rotor blades is provided with an associated and group-specifically designed blade type, the blade types of different groups of rotor blades differing from one another. In this case, rotor blades having different blade geometries are also understood to mean rotor blades whose blades intrinsically have the same geometry, but differ with regard to their relative position in relation to the blade platform. Here, it may be provided, for example, that the blades of the different groups also differ with regard to their material, their coating, or any desired combination of these properties. This makes a particularly effective frequency detuning of the rotor possible, since this in conjunction with the group-specifically designed blade platforms prevents any two rotor blades having identical blades from ever being installed flush with one another. Conversely, it is, however, advantageously not necessary to individually design every single blade of the rotor to achieve a sufficient frequency detuning.

Additional advantages result in that the at least two groups of rotor blades have blade platforms having matching lateral contact surfaces. This represents a structurally simple possibility of providing an integral protection against a mix-up and engaging adjacent rotor blades over the widest area possible.

Additional advantages result in that the contact surfaces have an oblique and/or wavy and/or serrated and/or irregular shape. The contact surfaces may, for example, form matching wedge-surfaces, thus achieving an increased friction between the rotor blades and thereby a mechanically particularly stable connection of adjacent rotor blades in addition to an integral protection against a mix-up. The design of the contact surfaces is, however, basically not limited to certain geometries. When designing the geometric shapes of the corresponding contact surfaces, it should only be made sure that the contact surfaces of one group of rotor blades are only engageable flush with the corresponding contact surfaces of another group of rotor blades, but not with the contact surfaces of the same group of rotor blades.

Another aspect of the present invention relates to a method for manufacturing a blade ring of a rotor for a turbomachine, in particular for a jet engine; according to the present invention, at least the steps are carried out of a) providing at least two groups of differently designed rotor blades, each group of rotor blades being assigned blade platforms, each of which is engageable flush with a matching blade platform of at least one other group of rotor blades and not with a blade platform of the same group of rotor blades, and b) arranging the rotor blades in the shape of the blade ring, each of the matching blade platforms of the at least two groups of rotor blades being engaged flush with one another. In this way, a simpler and more reliable manufacture of a rotor having a desirable vibration behavior is made possible, since it is ensured in a structurally simple manner that two identically designed rotor blades accordingly having identical vibration behavior can never be arranged flush with one another. In this way, an integral protection against a mix-up at the hub platform of the rotor is provided according to the present invention. Additional components are advantageously not needed to ensure protection against a mix-up so that there is no unfavorable effect on the weight of the rotor. The method according to the present invention thus makes it possible in a structurally simple and cost-effective manner to particularly reliably manufacture a blade ring or a rotor which is provided with such a blade ring and which has a desirable frequency detuning. Additional features and their advantages are derived from the previous descriptions.

In one advantageous embodiment of the present invention, it is provided that blade platforms of a first group of rotor blades and the blade platforms of a second group of rotor blades are alternatingly engaged in step b). In this way, only two different types of rotor blades having matching groups of blade platforms are needed, so that the blade ring may be manufactured particularly rapidly and reliably to have a desirable frequency detuning.

In another embodiment, a mechanically particularly stable connection of the blade ring to the rotor is possible in that the blade roots of the rotor blades are arranged and established in a matching groove of a rotor base body in step b). For this purpose, the blade roots of the individual rotor blades may be basically identical, i.e., group-independent. Alternatively, it may, however, also be provided that the rotor blades have group-specifically designed blade roots.

Additional advantages result in that at least two groups of rotor blades having different blade geometries are provided in step a). In other words, it is provided according to the present invention that rotor blades are used which have group-specifically designed blade types, the blade types of different groups of rotor blades differing from one another. Here, it may be provided, for example, that the blades of the different groups differ additionally with regard to their material, their coating, or any desired combination of these properties. This makes a particularly effective frequency detuning of the rotor possible, since this in conjunction with the group-specifically designed blade platforms prevents any two identical blades from ever being installed flush with one another. Conversely, it is, however, advantageously not necessary to individually design every single blade of the rotor to achieve a sufficient frequency detuning.

Another aspect of the present invention relates to a jet engine, it being provided according to the present invention that this jet engine includes a rotor according to one of the preceding exemplary embodiments and/or a blade ring which is manufactured with the aid of a method according to one of the preceding exemplary embodiments. The features resulting therefrom and their advantages are to be derived from the previous descriptions.

BRIEF DESCRIPTION OF THE DRAWINGS

Additional features of the present invention result from the claims, the exemplary embodiment, as well as with reference to the drawing. The features and the feature combinations mentioned previously in the description, as well as the features and the feature combinations mentioned subsequently in the exemplary embodiment are usable not only in the given combination, but also in other combinations or alone without departing from the scope of the present invention.

DETAILED DESCRIPTION

Figure 1:
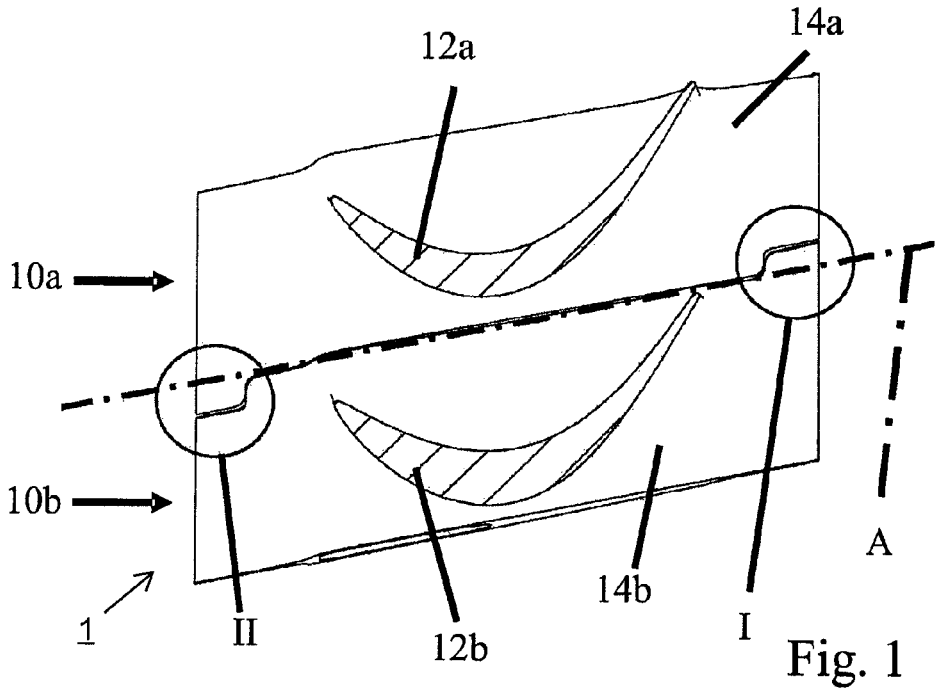
FIG. 1 shows a schematic top view of two rotor blades which are flush with one another.

FIG. 1 shows a schematic top view of two rotor blades 10*a*, 10*b*, which are flush with one another, during the manufacture of a blade ring of a rotor for a jet engine 1, shown schematically. Of rotor blades 10*a*, 10*b*, sectionally illustrated blades 12*a*, 12*b* are recognizable, which are connected to blade platforms 14*a*, 14*b* of rotor blades 10*a*, 10*b* and extend radially upward from blade platforms 14*a*, 14*b* in a manner known per se. Radially below blade platforms 14*a*, 14*b*, rotor blades 10*a*, 10*b* include respective blade roots 16*a*, 16*b* (see FIG. 2), via which rotor blades 10*a*, 10*b* are connected to a rotor base body, also in a manner known per se. It is apparent that the two rotor blades 10*a*, 10*b* include differently designed blade platforms 14*a*, 14*b* and belong to two different groups. Blade platforms 14*a*, 14*b* of the two groups of rotor blades 10*a*, 10*b* are flush with one another and form in the fully assembled blade ring or in the completed rotor a continuous, radially inner shroud, which delimits the flow path in the associated jet engine.

Furthermore, blades 12*a*, 12*b* are group-specifically designed, blades 12*a* and 12*b* of the same group having an identical blade geometry, and blades 12*a*, 12*b* of different groups having different blade geometries. Blade platform 14*a* which belongs to the first group of rotor blades 10*a* is designed in such a way that it is engaged flush with blade platform 14*b* which belongs to the second group of rotor blades 10*b* and is designed to match blade platform 14*a*. For this purpose, blade platform 14*a* of the first group has a recess, situated on the edge, with relation to dash-dotted parting plane A in area I and a projection, situated on the edge, in relation to dash-dotted parting plane A in opposite area II. Corresponding blade platform 14*b* of the second group accordingly has in area I a projection which is situated on the edge and matches the recess of blade platform 14*a* and in area II it has a recess which is situated on the edge and matches the projection of blade platform 14*a*.

It is apparent that parting plane A denotes here the theoretical parting plane between two conventionally designed rotor blades whose blade platforms have continuously flat contact surfaces and it is thus not possible to arrange them in such a way that they are reliably protected against a mix-up. To manufacture different rotor blades 10*a*, 10*b*, i.e., rotor blades 10*a* of the first group and rotor blades 10*b* of the second group, it may be provided that rotor blades having identically designed blade platforms are initially provided and the recesses and projections are subsequently produced with the aid of a corresponding milling treatment of blade platforms 14*a*, 14*b*.

FIG. 1 furthermore illustrates that blade platform 14*a* of the first group of rotor blades 10*a* is not engageable flush with another blade platform 14*a* of the first group, but only with blade platform 14*b* which belongs to the second group of rotor blades 10*b*. Accordingly, blade platform 14*b* which belongs to the second group of rotor blades 10*b* is only engageable flush with blade platform 14*a* which belongs to the first group, but not with another blade platform 14*b* of the second group. Therefore, two identical rotor blades 10*a*-10*a* or 10*b*-10*b* of the same group can never be installed flush with identical blade platforms 14*a*-14*a* or 14*b*-14*b*. To form a blade ring, blade platforms 14*a* of rotor blades 10*a* of the first group and blade platforms 14*b* of rotor blades 10*b* of the second group are instead alternatingly engaged flush with one another. Due to the group-specific designs of blade platforms 14*a*, 14*b*, it is always ensured at the same time that two identical blades 12*a*-12*a* or 12*b*-12*b* can never be arranged flush with one another. In this way, a particularly effective frequency detuning of the completed blade ring and thus the fully assembled rotor are reliably achieved.

Due to the integral protection against a mix-up of group-specifically designed rotor blades 10*a*, 10*b*, which is colloquially also referred to as a "foolproof design," it is reliably ruled out without the need for additional components that two identically designed rotor blades 10*a*-10*a* or 10*b*-10*b*, i.e., the rotor blades of the same group, are engaged flush with one another, since an obvious gap would always remain in this case between adjacent blade platforms 14*a*-14*a* or 14*b*-14*b*. The blade ring could then no longer be closed due to the resulting additional demand of installation space. It may basically also be provided that one or multiple additional groups of differently designed rotor blades having group-specifically designed blade platforms are used, the blade platforms always being designed in such a way that they are not engageable flush with the blade platforms of rotor blades of the same group, but with the blade platforms of rotor blades of at least one other group.

Alternatively or additionally to the shown recesses and projections, it may be provided that the recesses and projections are formed in lateral contact surfaces of blade platforms 14*a*, 14*b* of rotor blades 10*a*, 10*b* and form a type of tongue and groove joint. A structurally particularly simple protection against a mix-up may, for example, be achieved in that the first group of rotor blades 10*a* has bilateral projections (tongues) and the second group of rotor blades 10*b* has bilateral recesses (grooves).

Figure 2:
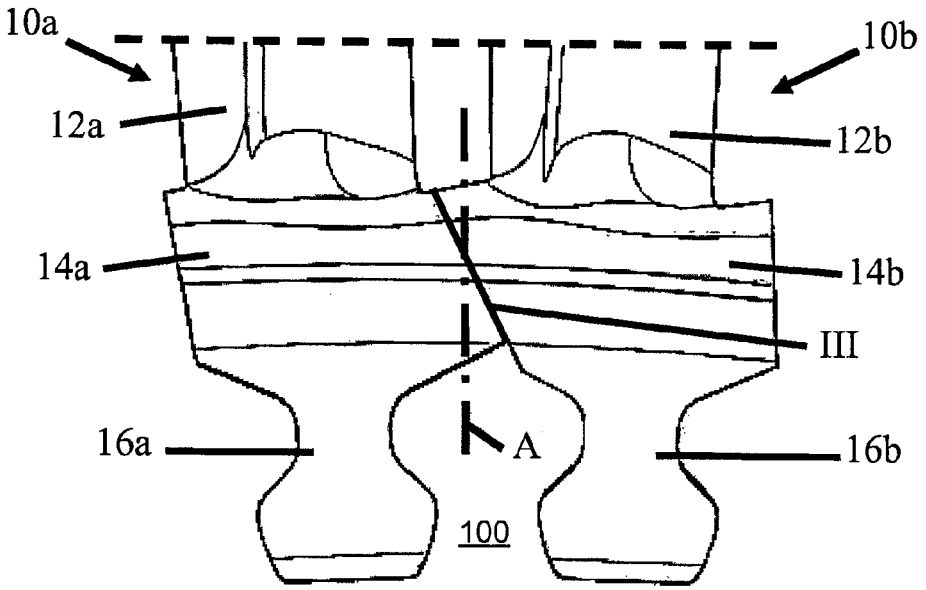
FIG. 2 shows a schematic front view of two alternatively designed rotor blades.

FIG. 2 shows a schematic front view of two alternatively designed rotor blades 10*a*, 10*b* during the manufacture of a blade ring of a rotor for a jet engine. Of rotor blades 10*a*, 10*b*, subsectionally illustrated blades 12*a*, 12*b* are recognizable which are connected to blade platforms 14*a*, 14*b* of rotor blades 10*a*, 10*b* and extend radially upward from blade platforms 14*a*, 14*b*. Radially below blade platforms 14*a*, 14*b*, rotor blades 10*a*, 10*b* each include respective blade roots 16*a*, 16*b* via which rotor blades 10*a*, 10*b* are connected to a rotor base body 100, shown schematically. Blade platforms 14*a*, 14*b* have matching lateral contact surfaces III. It is apparent that contact surfaces III are oblique or wedge-shaped in relation to parting plane A running along the axis of rotation of the rotor, so that blade platform 14*a* of the first group is only engageable flush with blade platform 14*b* of the second group, but not with another blade platform 14*a* of the first group. Similarly to the previous exemplary embodiment, blade platforms 14*a*, 14*b* of the two groups of rotor blades 10*a*, 10*b* form in the fully assembled blade ring or in the completed rotor a continuous, radially inner shroud, which delimits the flow path in the associated jet engine. The wedge-shaped design of the contact surfaces results in an increased friction between contact surfaces III, depending on the angle of the wedge. It is to be stressed, however, that contact surfaces III basically have any desired contour characteristic and may, for example, have a wavy and/or a serrated shape or other suitable projections/recesses. The important thing here is that contact surfaces III of the first group of rotor blades 10*a* are only engageable flush with corresponding contact surfaces III of the second (or another) group of rotor blades 10*b*, but not with contact surfaces III of the first group of rotor blades 10*a*.

What is claimed is:

1. A rotor for a turbomachine comprising:

a blade ring including at least a first group of rotor blades and a second group of rotor blades differently designed from the first group of rotor blades, the first group of rotor blades being assigned first blade platforms, each of which is engageable flush with a matching blade platform of the second group of rotor blades and not with another blade platform of the first group of rotor blades, the blade platforms of the second group of rotor blades also not being engageable flush with another blade platform of the second group of rotor blades, each blade platform of the first group of rotor blades having at least one recess situated on a first platform group edge, and an adjacent blade platform of the associated second group of rotor blades having a matching projection situated on a second platform group edge, arranged in a form-locked manner;

wherein each blade platform of the first group of rotor blades has the recess, situated on the first platform group edge, as well as an opposite projection, situated on the first platform group edge, wherein the opposite projection is located at an opposite side of the first platform group edge from the recess such that the opposite projection is spaced apart from the recess in the axial direction, wherein the axial direction is along an axis of rotation of the rotor, and each blade platform of the second group of rotor blades has the projection situated on the second platform group edge matching the recess of the blade platform of the first group and a further recess situated on the second platform group edge which matches the opposite projection, wherein the projection is located at an opposite side of the second platform group edge from the further recess such that the projection is spaced apart from the further recess in the axial direction.

2. The rotor as recited in claim 1 wherein the recesses and the matching projections are designed in the area of the lateral contact surfaces of the rotor blades of the first and second groups, the projections being form-locked in their respective recesses.

3. The rotor as recited in claim 1 wherein the first and second groups of rotor blades have different blade geometries.

4. The rotor as recited in claim 1 wherein the blade platforms of the first and second groups having matching lateral contact surfaces.

5. The rotor as recited in claim 4 wherein the contact surfaces have at least one of an oblique, wavy, serrated and irregular shape.

6. A jet engine comprising the rotor as recited in claim 1.

7. A method for manufacturing a blade ring of a rotor for a turbomachine including the following steps:

a) providing at least two groups of differently designed rotor blades, each group of rotor blades being assigned blade platforms, each of which is engageable flush with a matching blade platform of at least one other group of rotor blades and not with a blade platform of the same group of rotor blades; and b) arranging the rotor blades in the shape of the blade ring, each of the matching blade platforms of the at least two groups of rotor blades being engaged flush with one another, wherein each blade platform of a first group of the at least two groups of the rotor blades having at least one recess which is situated on a first platform group edge and in which a matching projection, situated on a second platform group edge, of an adjacent blade platform of an associated second group of the at least two groups of the rotor blades is arranged in a form-locked manner;

wherein each blade platform of the first group of rotor blades has the recess, situated on the first platform group edge, as well as an opposite projection, situated on the first platform group edge, wherein the opposite projection is located at an opposite side of the first platform group edge from the recess such that the opposite projection is spaced apart from the recess in the axial direction, wherein the axial direction is along an axis of rotation of the rotor; and wherein each blade platform of the second group of rotor blades has the projection situated on the second platform group edge matching the recess of the blade platform of the first group and a further recess situated on the second platform group edge which matches the opposite projection, wherein the projection is located at an opposite side of the second platform group edge from the further recess such that the projection is spaced apart from the further recess in the axial direction.

8. The method as recited in claim 7 wherein blade platforms of the first group of rotor blades and the blade platforms of the second group of rotor blades are alternatingly engaged in step b).

9. The method as recited in claim 8 wherein blade roots of the rotor blades are arranged and established in a matching groove of a rotor base body in step b).

10. The method as recited in claim 7 wherein at least two groups of rotor blades having different blade geometries are provided in step a).

11. A blade ring manufactured according to the method in claim 7.

12. A jet engine comprising the blade ring as recited in claim 11.

13. A method for manufacturing a blade ring of a rotor for a turbomachine including the following steps:

a) providing at least two groups of differently designed rotor blades, each group of rotor blades being assigned blade platforms;

b) forming, via a separation process, a recess on an edge of each blade platform of a first group and a projection on an opposite side of the edge of each blade platform of the first group, such that the recess and the projection are spaced apart in the axial direction, wherein the axial direction is along an axis of rotation of the rotor;

c) forming, via a separation process, a matching projection on an edge of each blade platform of a second group and a matching recess on an opposite side of the edge of each blade platform of the second group, such that the recess and the projection are spaced apart in the axial direction, and such that each blade platform is engageable flush with a matching blade platform of at least one other group of rotor blades and not with a blade platform of the same group of rotor blades; and d) arranging the rotor blades in the shape of the blade ring, each of the matching blade platforms of the at least two groups of rotor blades being engaged flush with one another, wherein each blade platform of the first group of the at least two groups of the rotor blades having the recess and the projection which is situated on the edge and in which the matching projection and the matching recess, situated on the edge of an adjacent blade platform of the second group of the at least two groups of the rotor blades, respectively, is arranged in a form-locked manner.

14. The method as recited in claim 13 wherein the separation process includes at least one of milling and grinding.

* * * * *